US006860700B2

(12) United States Patent
Powell et al.

(10) Patent No.: US 6,860,700 B2
(45) Date of Patent: Mar. 1, 2005

(54) SEED STORAGE AND TRANSPORTATION BIN

(75) Inventors: Michael Powell, Olive Branch, MS (US); Greg Volgas, Memphis, TN (US); Lent E. Thomas, III, Batesville, MS (US)

(73) Assignee: Helena Holding Company, Wilmington, DE (US)

( * ) Notice: Subject to any disclaimer, the term of this patent is extended or adjusted under 35 U.S.C. 154(b) by 0 days.

(21) Appl. No.: 10/365,968

(22) Filed: Feb. 13, 2003

(65) Prior Publication Data

US 2004/0016378 A1 Jan. 29, 2004

Related U.S. Application Data

(60) Provisional application No. 60/357,019, filed on Feb. 13, 2002.

(51) Int. Cl.[7] ..... B65G 67/02

(52) U.S. Cl. ..... 414/523

(58) Field of Search ..... 111/73–78, 174–176; 414/327, 343, 390, 505, 523, 528, 526; 198/311–318; 222/413, 608, 626–637

(56) References Cited

U.S. PATENT DOCUMENTS 5,915,312 A 6/1999 Meyer et al. ..... 111/174
6,120,233 A 9/2000 Adam ..... 414/502

*Primary Examiner*—Robert E Pezzuto
(74) *Attorney, Agent, or Firm*—Connolly Bove Lodge & Hutz LLP

(57) ABSTRACT

A bulk seed storage and dispensing box of the present invention uses properly angled box sides to assist in the flow of the seed from the box. A side discharge opening is essential for ease of use of this invention.

25 Claims, 1 Drawing Sheet

SEED STORAGE AND TRANSPORTATION BIN

RELATED APPLICATIONS

This application claims benefit to provisional application Ser. No. 60/357,019 filed Feb. 13, 2002, which is incorporated by reference in its entirety for all useful purposes.

BACKGROUND OF THE INVENTION

Many types of agricultural seeds are handled numerous times before the seed is actually planted. The seed may be coated with a variety of treatments, including fungicides, insecticides, or nutritional supplements. In treating seed, some of the seeds are inevitably damaged by rough handling.

Agricultural seeds are often delivered to the grower in bags. Bags are heavy and difficult to handle. In many cases, seed is delivered to the grower in large boxes or hoppers because this is a more economical way for the grower to use the seed than bags.

Conventional row crop seed handling is performed with a wide variety of boxes and hoppers. These boxes and hoppers are used for storing both treated and untreated agricultural seed, and also for carrying the seed to the growers' fields. In many instances, an auger or some other method has been used to dispense the seed out of the box and into the grower's planting equipment. U.S. Pat. No. 6,120,233 discloses a seed carrier and dispenser using an auger discharge. U.S. Pat. No. 5,915,312 discloses the use of a pneumatic seed delivery system. The uses of some of the methods of transporting seeds, such as an auger, are known to cause damage to the seed.

Damaged seed means a poor plant stand, which in turn means loss of yield and profit potential for the grower. To further aggravate this situation, the advent of biotechnology has driven the value and cost of seeds higher and higher.

Side discharge seed dispensers have been developed, but have problems. Previous side discharge seed dispensers, such as the Buckhorn seed box, used a different box shape, which prevented the seed from completely flowing out of the unit. The angled floor of the box allows proper flow of some seeds, but others have to be shoveled out by hand.

Today, seed boxes commonly have bottom discharge openings through which the seeds flow. These seed boxes have two distinct disadvantages. They cannot conveniently or safely be carried on a truck bed to the field. The bottom discharge outlet requires that the seed box be elevated, thus causing the truck be to become top heavy and often unsafe. Some manufacturers have engineered around this problem by using augurs or vacuums to move the seed from the bottom of the seed box to a level convenient for grower access. As pointed out before, this extra step in handling seeds can damage the seeds.

SUMMARY OF THE INVENTION

The invention is a seed storage bin that relies on the gravity flow of seeds through a side-discharge outlet. The enclosure has an opening on its side where a farmer can dispense the seed into a container such as a bucket and pour the seed into a planter hopper. Most commercial seed bins today move seed out of the bin by use of an auger or a conveyor belt system. In some commercially available seed bins, seed is dropped out of the bin in a center discharge outlet. The drawback of this center discharge outlet is that the entire bin must be lifted high off the ground in order to access the seed. This poses safety risks and other problems. This invention can be practiced without the use of an auger or a conveyor belt system.

The flow of seed out of the bin is controlled by a simple sliding door covering the side discharge opening. Said sliding door can be operated either manually or automatically by some form of remote control.

The side walls of this seed bin are angled down and toward the discharge opening in a manner in which all of the seed readily flows to the opening. The angle of the side walls is sufficient to ensure proper flow of even cotton or corn seeds, which due to their shape are difficult to handle. The angle of the walls is at least 40 degrees off of vertical.

The door covering the side discharge outlet can be secured to prevent spillage or theft of the seed.

One advantage of such a system is that the seed is not mishandled by an auger or conveyer belt system. Such handling, while providing ease of use for a grower, can cause a dramatic reduction in seed viability.

In most cases, this seed bin will not be collapsible. In many collapsible seed bins, a cardboard sleeve or insert is required. Another advantage of this new system is that no such insert is required.

DETAILED DESCRIPTION OF THE INVENTION

Figure 1:
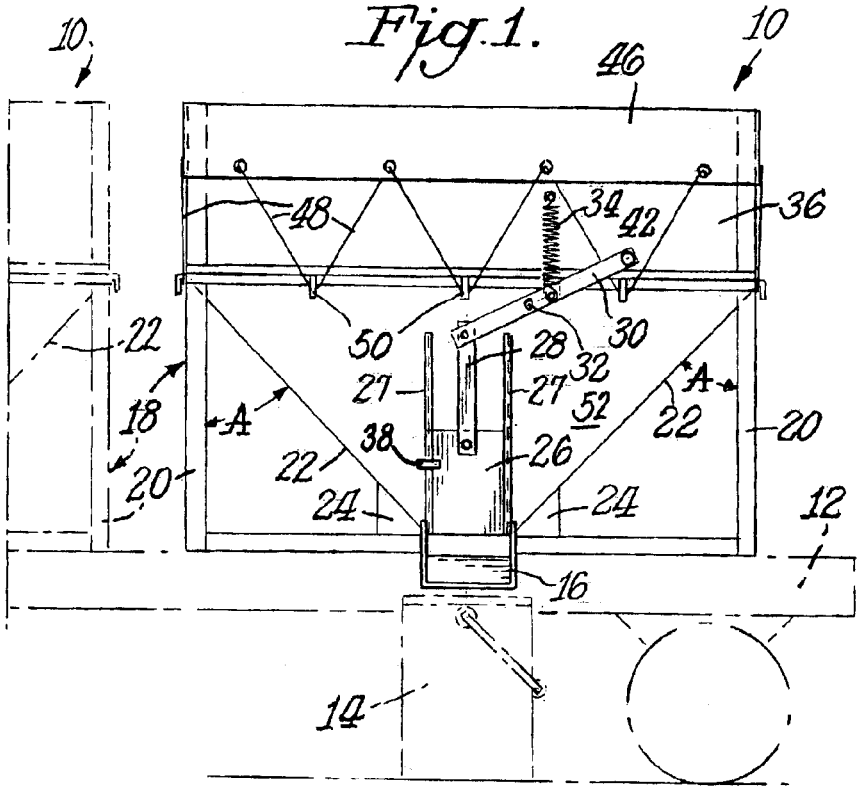
FIG. 1 is a front elevational view of a seed bin loaded on a flat bed trailer and FIG. 2 is a left side elevational view of the seed bin shown in FIG. 1.

FIG. 1 illustrates at least one full portable seed bin 10 that can be transported on a flat bed trailer 12 to a field that is going to be planted. Treated seed is transferred from the seed bin 10 to a container 14 via a spout 16. The container 14 can be any commercially available container that can hold seed such as, but not limited to buckets (for example 5, 4, 3, 2 or 1 gallon buckets). Then the seed filled containers 14 are carried to a mechanical seeder and the seed is dumped into the seed hoppers.

The frame 18 holds the seed bin 10. The frame 18 can be made of plastic, metal or any other material sufficiently sturdy to hold the weight of the seed and seed bin combined. The seed bin 10 can also be made of plastic, metal or any other material sufficient to resist deformation by the weight of the seed. Support posts 20 that can be made of plastic, metal or any other material sufficiently sturdy to hold the weight of the seed 44 and bin 10 combined. The seed bin 10 has opposing slope sides 22 that helps to funnel the seed down to the spout 16. The angle A that this seed bin 10 makes with the side posts 20 is 60 degrees or less, preferably 50 degrees or less, more preferably 40 degrees or less and even more preferably 30 degrees or less and most preferably 20 degrees or less. The two angles A of the opposing sloping sides maybe of the same angle or different angles.

In FIG. 1, the seed bin 10 is shown from the front side. The front, in this instance, means the side where the seed is discharged. A pair of supports 24 can be made of plastic, metal or any other material suitable to support the weight of the bin and the seed 44. The seed 44 is poured from the spout 16. A sliding door 26 alternately holds seed 44 in the seed bin 10 when the sliding door 26 is closed, or when open, allows the seed 44 to flow out. The door 26 as shown opens up, but alternately, can be rigged to open downward. The door 26 is guided vertically in "L" shaped guide tracks 27. A connection arm 28 is between the lever arm 30 and the door 26. The lever arm 30 is operated to slide open or close the door 26. A spring 34 attached to the lever arm 30 and side wall of the seed hopper 36 helps to reset the lever 30 and the door 26 to the closed position. The direction that the door 26 slides to close or open can be modified on different seed bins.

The seed hopper or seed enclosure 36 of the seed bin 10 itself, can be made of plastic, metal or any other material suitable to support the weight of the seed. A locking mechanism 38 can be used to lock the seed bin door 26 shut. The locking mechanism 38 can be any conventional locking system, such as, but not limited to hinge and eye with the ability to place a lock through the eye and a conventional sliding bolt mechanism. A third sloped wall 40 in the seed bin 36 helps to further funnel the seed 44 down into the spout 16.

Figure 2:
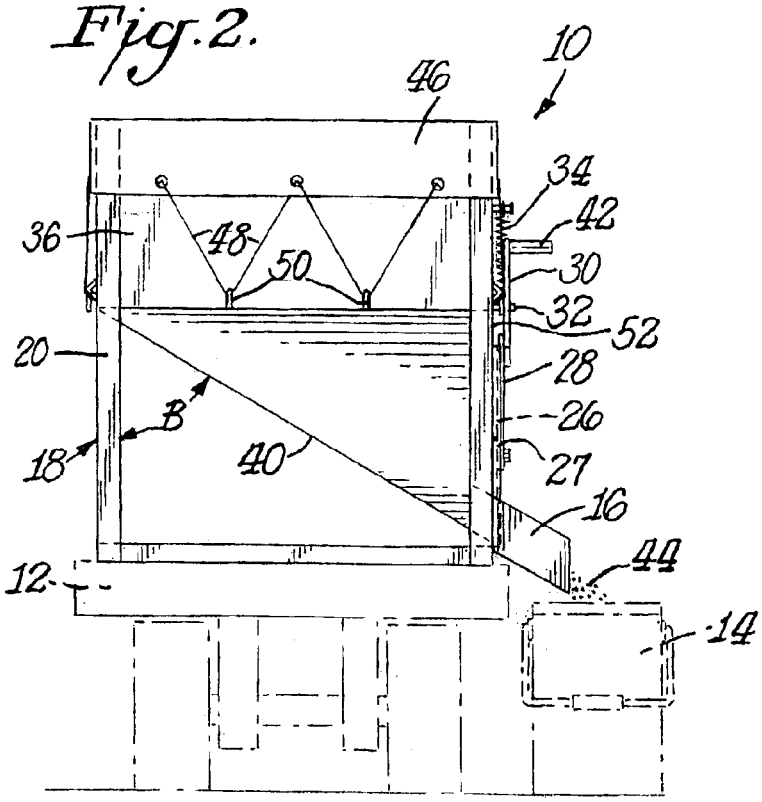

As shown in FIG. 2, the angle B of the sloped wall 40 relative to the side post 20 is 60 degrees or less, preferably 50 degrees or less, more preferable 40 degrees or less, and even more preferably 30 degrees or less and most preferably 20 degrees or less. The frame 20 can be made of plastic, metal or any other material sufficiently sturdy to hold the weight of the seed and bin.

As shown in FIG. 1 and FIG. 2, the seed bin hopper 36 has three sloping walls 22, 22, 40 and a front vertical wall 52 to help move the seed from the back and sides of the bin to the front of the bin where the seed is discharged.

An optional grip 42 attached to the lever 30 when pushed downward causes the door 26 to open to allow discharge of the seed 44. An optional tarpaulin 46 attached by any conventional means such as, but not limited to a spring and cords 48 to hooks 50 as shown in FIGS. 1 and 2. The tarpaulin 46 is used to prevent contamination of the seed by airborne pollutants, weather conditions, such as rain, hail, snow, etc.

All the references discussed above are incorporated by reference in its entirety for all useful purposes.

While there is shown and described certain specific structures embodying the invention, it will be manifest to those skilled in the art that various modifications and rearrangements of the parts may be made without departing from the spirit and scope of the underlying inventive concept and that the same is not limited to the particular forms herein shown and described.

FIGURE NOMENCLATURE

10—seed bin
12—flat bed trailer
14—container
16—spout
18—frame
20—support posts
22—opposing angled sides
24—supports
26—sliding door
27—L shaped guide tracks
28—connection arm
30—lever arm
32—pivot pin
34—spring
36—seed hopper
38—locking mechanism
40—third sloped wall
42—grip
44—seed
46—tarpaulin
48—spring cord
50—hooks
52—front wall

We claim:

1. A portable apparatus for storing, transporting, or dispensing bulk seeds which comprises an enclosure comprising two opposing angled side walls and one angled back wall converging to a vertical front wall, and an opened or semi opened top for loading the bulk seeds, said enclosure has an opening located in the front wall towards the bottom of the front wall thereby forming a side discharge from said front wall and a door that can be moved to expose said opening to permit seed to flow from said enclosure or cover said opening to keep the seed in said enclosure and said enclosure is supported by vertical support posts and has two opposing angled side walls having an angle that is identical or different and is less than or equal to 60 degrees from the vertical support posts to said enclosure, and said angled back wall having an angle of less than or equal to 60 degrees from the vertical support posts to said enclosure.

2. The apparatus as claimed in claim 1, which further comprises a discharge spout extending from the opening and said opening is within the confines of said two angled side walls and the angled rear wall.

3. The apparatus as claimed in claim 1, wherein said angle from the angled side walls is less than about 50 degrees from said vertical supports to said enclosure.

4. The apparatus as claimed in claim 1, wherein said angle from the angled side walls is less than about 40 degrees from said vertical supports to said enclosure.

5. The apparatus as claimed in claim 1, wherein said angle from the angled side walls is less than about 30 degrees from said vertical supports to said enclosure.

6. The apparatus as claimed in claim 1, wherein said angle from the angled side walls is less than about 20 degrees from said vertical supports to said enclosure.

7. The apparatus as claimed in claim 3, wherein said angle from the angled back wall is less than about 50 degrees from said vertical supports to said enclosure.

8. The apparatus as claimed in claim 4, wherein said angle from the angled back wall is less than about 40 degrees from said vertical supports to said enclosure.

9. The apparatus as claimed in claim 5, wherein said angle from the angled back wall is less than about 30 degrees from said vertical supports to said enclosure.

10. The apparatus as claimed in claim 6, wherein said angle from the angled back wall is less than about 20 degrees from said vertical supports to said enclosure.

11. The apparatus as claimed in claim 1, wherein said enclosure does not employ an auger or conveyer belt system for moving the seeds.

12. The apparatus as claimed in claim 1, wherein said angle from the angled side walls is less than about 20 degrees from said vertical supports to said enclosure and said angle from the angled back wall is less than about 20 degrees from said vertical supports to said enclosure.

13. The apparatus as claimed in claim 1, wherein said box does not employ a pneumatic device for moving the seeds.

14. The apparatus as claimed in claim 13, wherein said angle from the angled side walls is less than about 20 degrees from said vertical supports to said enclosure and said angle from the angled back wall is less than about 20 degrees from said vertical supports to said enclosure.

15. The apparatus as claimed in claim 1, wherein said door is a spring-loaded door.

16. The apparatus as claimed in claim 1, wherein said door slides open from the bottom.

17. The apparatus as claimed in claim 1, which further comprises a tarpaulin attached to the top of said enclosure.

18. A process for transporting seed to a field which comprises loading seed into the portable apparatus as claimed in claim 1, placing at least one of said portable apparatus on a truck bed and transporting the apparatus to a location where the seed is emptied into a smaller container used for transporting and filling the seed dispensing equipment.

19. The process as claimed in claim 18, wherein said smaller container is a bucket that is 5 gallons or less.

20. The process as claimed in claim 19, wherein the portable apparatus is covered with a tarpaulin during transportation of said apparatus.

21. The apparatus as claimed in claim 1, wherein said door has a lever arm that opens or closes the door.

22. The apparatus as claimed in claim 21, wherein said lever arm has a spring attached to said lever arm and said enclosure.

23. The apparatus as claimed in claim 22, wherein said enclosure further comprises guide tracks for said door permitting said door to slide in said guide tracks.

24. A portable apparatus for storing, transporting, or dispensing bulk seeds which comprises an enclosure comprising two opposing angled side walls and one angled back wall converging to a vertical front wall, and an opened or semi opened top for loading the bulk seeds, said enclosure has an opening located towards the bottom of the front wall and a door that can be moved to expose said opening to permit seed to flow from said enclosure or cover said opening to keep the seed in said enclosure and said enclosure is supported by vertical support posts and has two opposing angled side walls having an angle that is identical or different and is less than or equal to 60 degrees from the vertical support posts to said enclosure, and said angled bank wall having an angle of less than or equal to 60 degrees from the vertical support posts to said enclosure and wherein the apparatus has a bottom surface, and when said apparatus is placed on a flat bed truck said bottom surface of said apparatus will be capable of making direct contact with said flat bed truck.

25. A portable apparatus for storing, transporting, or dispensing bulk seeds which comprises an enclosure comprising two opposing angled side walls and one angled back wall converging to a vertical front wall, and an opened or semi opened top for loading the bulk seeds, said enclosure has an opening located in the front wall towards the bottom of the front wall thereby forming a side discharge outlet from said front wall, a spout connected to said opening which can permit seed to flow from said enclosure and a door that can be moved to expose said opening to permit seed to flow from said enclosure or cover said opening to keep the seed in said enclosure.

* * * * *